US008591270B1

(12) United States Patent
Ramsey et al.

(10) Patent No.: US 8,591,270 B1
(45) Date of Patent: Nov. 26, 2013

(54) FORMED SPRING CONTACT

(75) Inventors: James M Ramsey, Frisco, TX (US); Jose L. Ortega, Bedford, TX (US)

(73) Assignee: Plastronics Socket Partners, Ltd., Irving, TX (US)

( * ) Notice: Subject to any disclaimer, the term of this patent is extended or adjusted under 35 U.S.C. 154(b) by 49 days.

(21) Appl. No.: 13/439,764

(22) Filed: Apr. 4, 2012

Related U.S. Application Data

(60) Provisional application No. 61/471,635, filed on Apr. 4, 2011.

(51) Int. Cl.
*H01R 13/24* (2006.01)

(52) U.S. Cl.
USPC ..... 439/824; 439/700

(58) Field of Classification Search
USPC ..... 439/289, 824, 700
See application file for complete search history.

(56) References Cited

U.S. PATENT DOCUMENTS

| | | | | |
|---|---|---|---|---|
| 5,529,510 | A * | 6/1996 | Wakata et al. | 439/310 |
| 5,871,379 | A * | 2/1999 | Tanaka et al. | 439/824 |
| 7,485,011 | B2 * | 2/2009 | Hsu | 439/700 |
| 8,157,601 | B2 * | 4/2012 | Lin et al. | 439/700 |
| 8,210,855 | B1 * | 7/2012 | Lin | 439/66 |

* cited by examiner

*Primary Examiner* — Khiem Nguyen
(74) *Attorney, Agent, or Firm* — Mark W Handley

(57) ABSTRACT

A spring contact (12) has a tail contact (14) and a tip contact (16) which are secured together in a telescoping arrangement. The tail contact (14) is formed as a first single element member (22) having two contact arms (28) which are spaced apart and extend forward to engage the tip contact (16). Two contact protuberances (34) extend outward from respective edges the two contact arms (28). The tip contact (16) is formed of a second single element member (50) having two elongate sides (58) and a mounting protrusion (56) which rearwardly extend in parallel toward the tail contact (14). The two sides (58) extend in a cantilever arrangement and have two elongate slots (66) formed therein for receiving respective ones of the contact protuberances (34).

17 Claims, 4 Drawing Sheets

FORMED SPRING CONTACT

CROSS-REFERENCE TO RELATED APPLICATION

The present application is related to and claims priority to U.S. Provisional Patent Application Ser. No. 61/471,635, filed Apr. 4, 2011, invented by James M. Ramsey and Jose L. Ortega, entitled, "Formed Spring Contact," and assigned to PLASTRONICS SOCKET PARTNERS, LTD., a limited partnership under the laws of the State of Texas, having a general partner of PLAS2, LLC, a limited liability company under the laws of the State of Texas, the assignee of the present application.

TECHNICAL FIELD OF THE INVENTION

The present invention relates in general to spring contacts for making electrical connections between components, and in particular to spring contact having contact components formed of metal stampings.

BACKGROUND OF THE INVENTION

Prior art spring contacts have been provided for making electrical connections between components in various circuits. In one application, spring contacts are used for making connections between separable connector halves which are releasably joined, such as those used in cell phones for battery connectors. A spring contact having contact components formed of metal stampings may be used to provide low cost spring contacts.

SUMMARY OF THE INVENTION

A spring contact is disclosed having a tail contact and tip contact which are secured together in a telescoping arrangement, with the tail contact and the tip contact interlocked to prevent separation thereof. A bias member is provided to push the tail contact and the tip contact apart. The tail contact is formed as a first single element member, or a single stamping, having a generally Ushaped form. A first side of said U-shaped form has a connecting protrusion and two resilient contact arms. The two contact arms are spaced apart to define a space there-between which is disposed adjacent to a base portion of the connecting protrusion. The two resilient contact arms extend in a forward direction and the connecting protrusion is formed to extend in a rearward direction. The two contact arms have contact protuberances which outwardly extend from outwardly disposed edges thereof. A second side of the U-shaped form has two spaced apart mounting barbs. The U-shaped form provides a pocket for retaining a rearward end portion of the bias member between the two mounting barbs and the two contact arms.

The tip contact is formed of a second single element member, or a single stamping, having a central portion from which a contact end forwardly extends. Two elongate sides and a mounting protrusion for the bias member which rearwardly extend from the central portion. The two elongate sides extend from opposite sides of the central portion in parallel and in opposed relation. The mounting protrusion extends parallel to the two elongate sides, in orthogonal relation to the two elongate sides. The two sides have rearward end portions which rearwardly extend in cantilever arrangement from the central portion. Two elongate slots are formed into the rearward end portions, with the two elongate sides configured for receiving respective ones of the contact protuberances into the slots with said contact arms of the tail contact disposed between the rearward end portions of the two elongate sides. The mounting protrusion extends toward an intermediate portion of the U-shaped form the tail contact, intermediate between the contact arms and the two mounting barbs. A forward end of the bias member extends around and receives the mounting protrusion, and a rearward end of the bias member is disposed within the pocket defined between the two contact arms and the two mounting barbs.

DESCRIPTION OF THE DRAWINGS

For a more complete understanding of the present invention and the advantages thereof, reference is now made to the following description taken in conjunction with the accompanying Drawings in which

FIG. 1 is a perspective view of a spring contact having a tail contact, a tip contact and a spring bias element;

FIG. 2 is a perspective view of the spring contact;

FIG. 3 is a perspective view of a spring contact;

FIG. 4 is an exploded view of the spring contact;

FIG. 5 is an exploded view of the spring contact;

FIG. 6 is a perspective view of a tail contact;

FIG. 7 is a perspective view of a tail contact;

FIG. 8 is a perspective view of the tip contact; and

FIG. 9 is a perspective view of the tip contact.

DETAILED DESCRIPTION OF THE INVENTION

Figure 1:
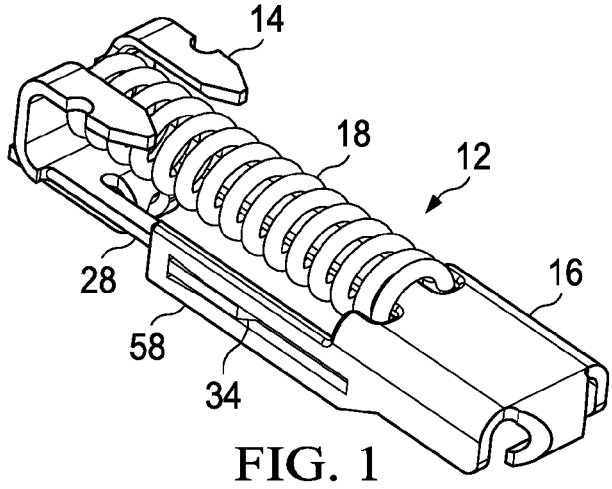
FIGS. 1 through 9 show various aspects for the formed spring contact made according to the present invention, as set forth below.
Figure 2:
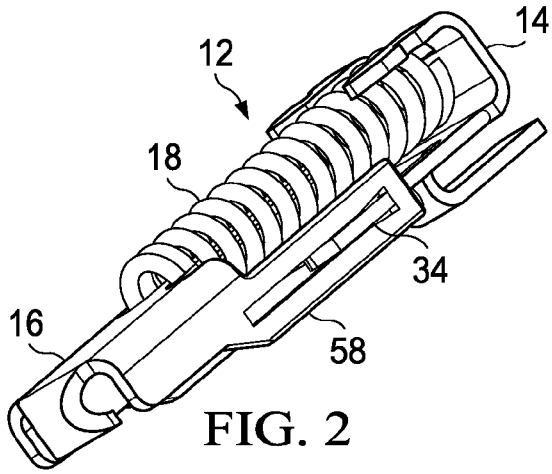
Figure 3:
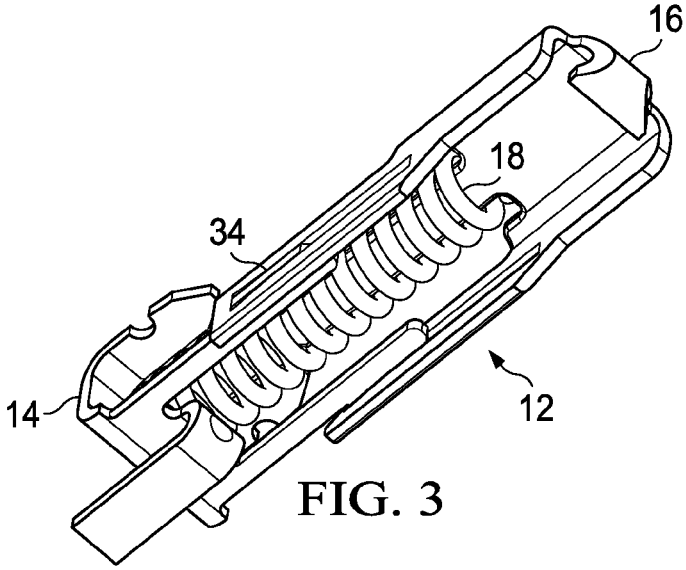

FIGS. 1, 2 and 3 are perspective views of a spring contact 12 having a tail contact 14, a tip contact 16 and a spring bias element 18. The tail contact 14 and the tip contact 16 are telescopically coupled together and urged apart by the spring 18.

Figure 4:
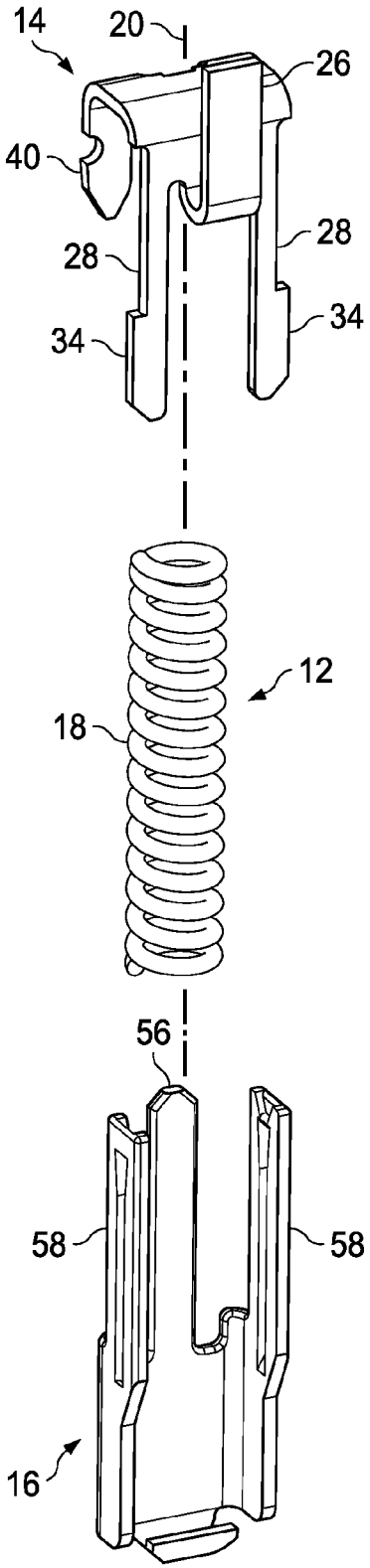
Figure 5:
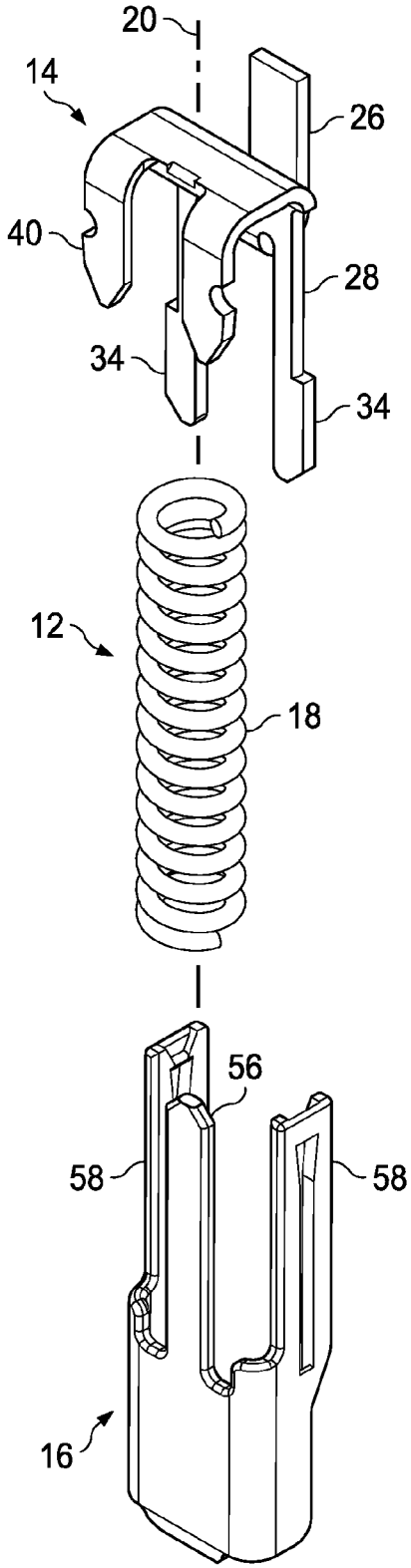

FIGS. 4 and 5 are exploded views of the spring contact 12. The tail contact 14 is formed of a first single element member 22 provided by a single metal stamping, as one piece. Similarly, the tip contact 16 is formed of a second single element member 50 provided by a single metal stamping, as one piece. The tail contact 14 has two forwardly extending contact arms 28 which are slidingly secured in elongate slots 66 formed into two rearwardly extending elongate sides 58 of the tip contact 16. A mounting protrusion 56 rearwardly extends from the tip contact 16 for being received in a forward end of a bias member 18, which is preferably a wound coil spring. The tail contact 14 is preferably of a generally U-shape having two mounting barbs 40 which are spaced apart and extend in opposed relation to the two contact arms 28 to define a pocket in which a rearward end of the bias member 18 is trapped to retain the rearward end portion bias member 18 is fixed relation to the tail contact 14. A connecting protrusion extends rearward from the tail contact 14 and a contact end 54 is formed on a forward portion of the contact tip 54.

Figure 6:
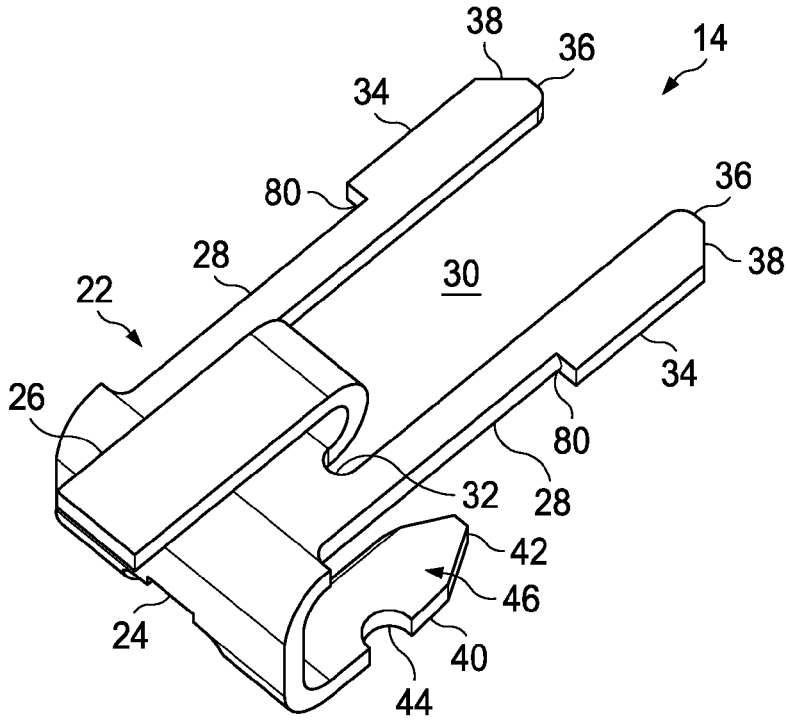
Figure 7:
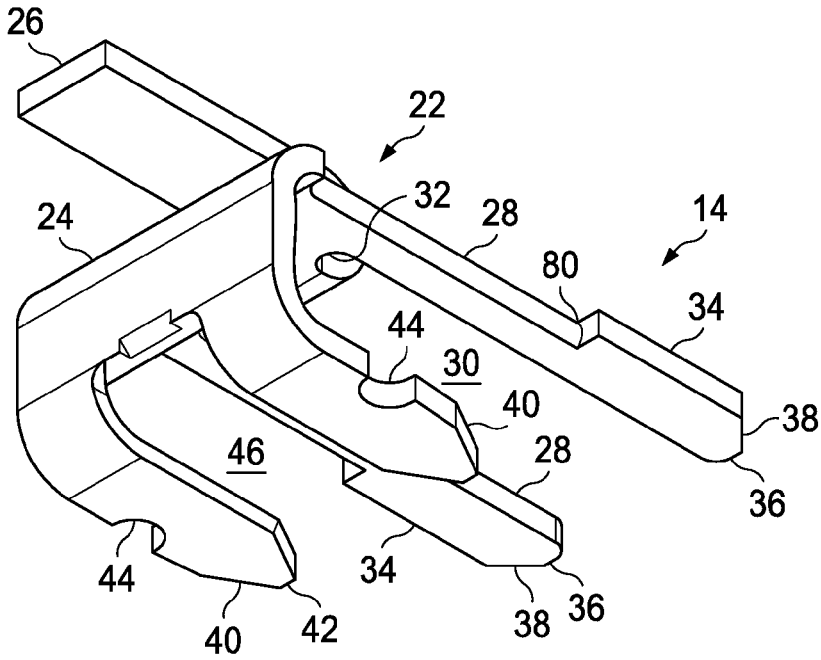

FIGS. 6 and 7 are perspective views of the tip contact 16. The first single element member 22 providing the tail contact 14 has a main body portion 24 which is of a U-shaped form. One side of the U-shaped form defining the main body portion 24 has the connecting protrusion 26 disposed between the two resilient contact arms 28. A space 30 defines a gap between the two resilient contact arms 28, adjacent to a base portion of the connecting protrusion 26. Two relief notches 32 are disposed on opposite sides of the connecting protrusion 26. The connecting protrusion 26 defines a rearwardly extending tab for electrically connecting the spring contact 12 to a socket base. The two resilient contact arms 28 have forwardly disposed contact protuberances 34 which extend outward, or laterally aside, from outwardly disposed edges of the two resilient contact arms 28. The terminal end tips 36 of the two resilient contact arms 28 have chamfers 38, to aid insertion into the tip contact 16. A second sided of the U-shaped form of the main body 24 defines two spaced apart mounting barbs 40. Terminal ends 42 of the mounting barbs 40 both have double sided chamfers. Recess 44 are provided in intermediate portions of the mounting barbs 40 for assisting in mounting the tail contact 14 into a connector housing or socket. The U-shaped form of the main body portion 24 defines the pocket 46 for trapping a rearward portion of the spring bias element 18 between the two mounting barbs 40, and the contact arms 28, and an intermediate portion of the main body portion 24 which is disposed directly adjacent to the base portion of the connecting protrusion.

Figure 8:
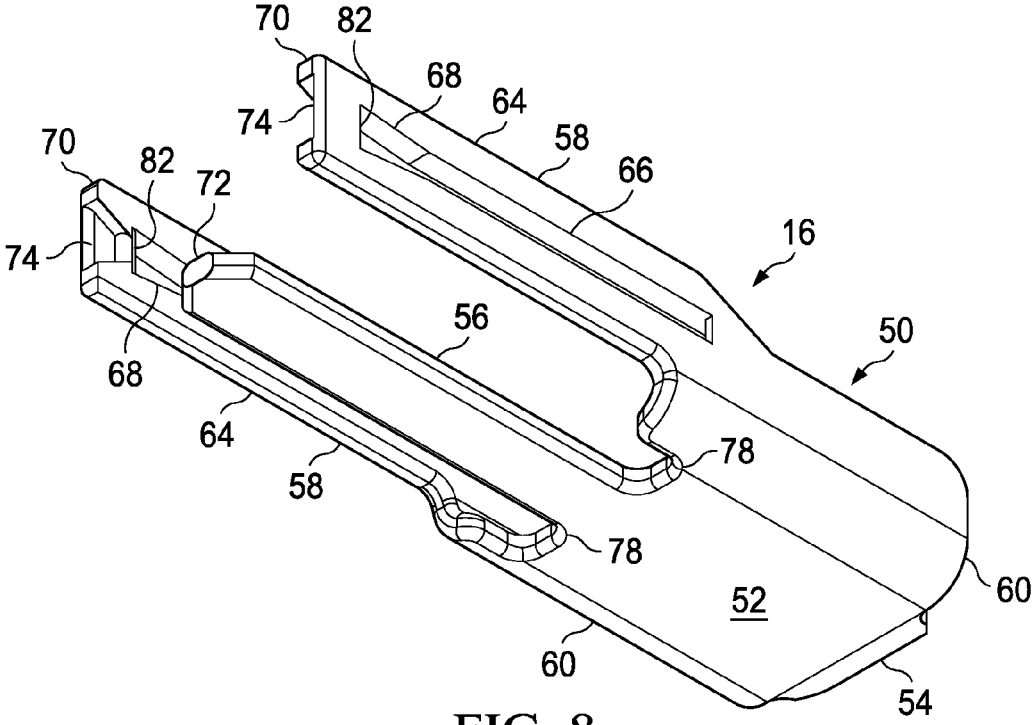
Figure 9:
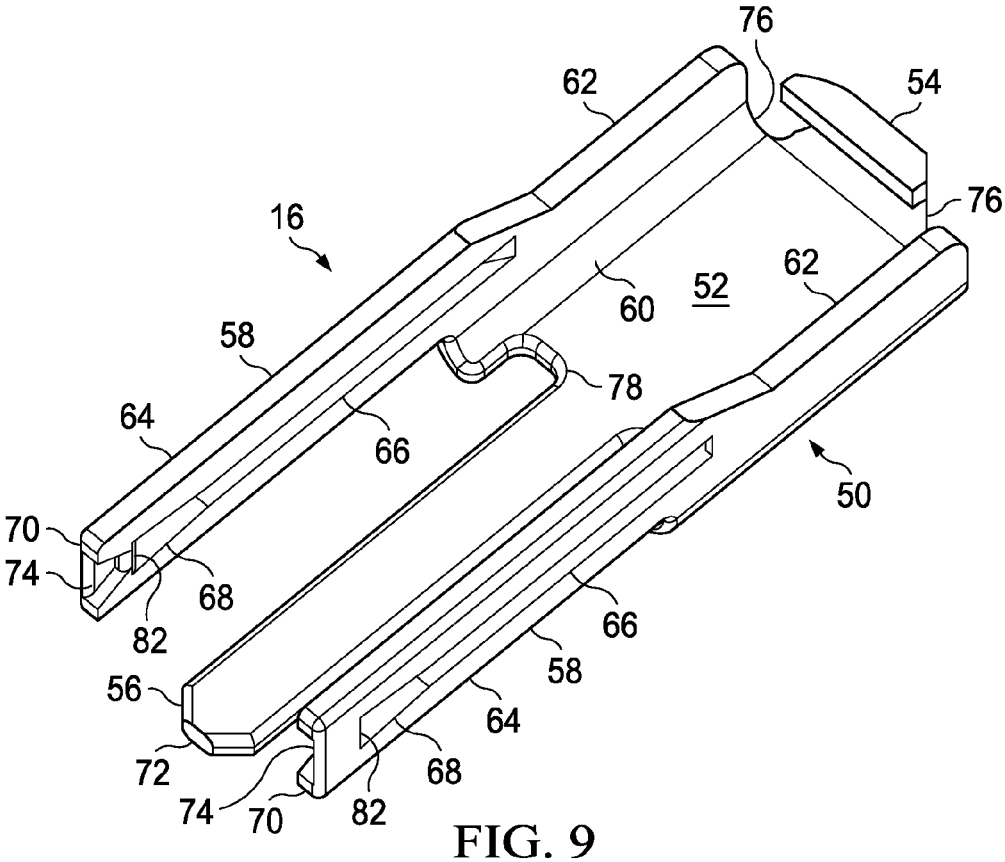

Referring to FIGS. 8 and 9, the second single element member 50 providing the tip contact 16 is formed to define a central portion 52 having the contact end 54 formed on a forward portion thereof, a mounting protrusion 56 and the two elongate sides 58. A bend portion 60 is defined between the central portion 52 and the elongate sides 50. A forward end portion 62 of the elongate sides 58 extends directly adjacent into the central portion 52, with the bend portion 60 connecting directly there-between. The rearward end portion 64 of the elongate sides 58 rearwardly extends from adjacent the bend portion 60 and the central portion 52 in a cantilever arrangement. The elongate slots 66 are formed at least in the rearward portion 64 of the elongate sides 58. Preferably, the elongate slots 66 extend with a longitudinal length which is parallel to the central longitudinal axis 20 of the spring contact 12. The rearward-most ends of elongate slots 66 have an enlarged leadin space 68 to aid in assembly. The elongate sides 58 have rearward tips 70 and the spring mounting protrusion 56 has a rearward tip 72. Preferably, the rearward tip 72 has chamfers on both sides and is disposed adjacent to and in line with the rearward tips 70 of the elongate sides 58. Guide notches 74 are formed into inward, flat sides of the elongate sides 56 of the end tips 70 to guide the contact protuberances 34 of the two resilient contact arms 28 into alignment with the enlarged lead-in spaces 68 of the elongate slots 66 to aid in assembly. Relief notches 76 are provided on opposite sides of the contact end 54 formed in a forward portion of the single element 50. Relief notches 78 are formed on opposite sides at the base portion of the mounting protrusion 56, adjacent to the central portion 52.

Preferably, the shoulders 80 defined by the contact protuberances 34 are at a right angles to respective ones of the outward edges of the contact arms 28. Similarly, shoulders 82 are defined by the rearward most edges of the elongate slots 66 in the sides 58 which are also at right angles to the outward side surfaces of the elongate sides 58. The shoulders 80 and 82 are at right angles to the respective surfaces noted above, such that the will be substantially parallel and engage as stops to interlock the tail contact and the tip contact together. The outward edges of the contact protuberances 34 also preferably fit flush with the outward sides of the elongate sides 58. Note is also made that preferably, the ent tip 72 of the mounting protrusion 56 is aligned with the rearward tips 70 of the elongate sides 58, being disposed in the same plane.

The tail contact 14 is slidably secured to the tip contact 16 in the telescoping arrangement with the contact protuberances 34 extending outwardly and to the sides from edges of the two resilient contact arms 28. The contact arms 28 are slidable disposed adjacent to and interiorly of respective ones of the elongate sides 58 of the tip contact 16, with the contact protuberances 34 slidably extending into the elongate slots 66 of rearward end portions 64 the elongate sides 58. The protuberances 34 slidably engage within the elongate slots 66 to telescopically couple together the tail contact 14 and the tip contact 16. The spring pocket 46 is defined in the tail contact by a U-shaped profile defined between the two spaced apart contact arms 28 and the two spaced apart mounting barbs 40. The bias spring 18 fits over the mounting protrusion 56 and within the spring pocket 46 for being retained between the tail contact 14 and the tip contact 16, and urging the tail contact 14 and the tip contact 16 into telescopically extended positions.

The present invention provides a spring contact formed of two stamped components and a bias member. The two stamped components are easily assembled in a telescoping arrangement, with the bias member mounted between the two stamped components. Outwardly extending protrusions of one of the stamped members fit within elongate slots of the other of the stamped members to slidably secure the two stamped components together in the telescoping arrangement. A bias spring is retained to extend between the two stamped contact components for urging the two components into telescopically spaced apart positions.

Although the preferred embodiment has been described in detail, it should be understood that various changes, substitutions and alterations can be made therein without departing from the spirit and scope of the invention as defined by the appended claims.

What is claimed is:

1. A spring contact comprising:

a tail contact formed of a first single element member having a main body portion which is of a U-shaped form, wherein a first side of said U-shaped form has a connecting protrusion and two resilient contact arms, said two resilient contact arms are spaced apart to define a space there-between which is disposed adjacent to a base portion of the connecting protrusion, said two resilient contact arms extend from said main body portion in a forward direction and said connecting protrusion is formed to extend from said main body portion in a rearward direction, and wherein said U-shaped form provides a pocket;

a tip contact formed of a second single element member having a central portion from which a contact end forwardly extends, and two elongate sides, wherein said two elongate sides extend in parallel and in opposed relation from opposite sides of said central portion, and said two sides having rearward end portions which rearwardly extend in cantilever arrangement from said central portion with two elongate slots formed into said rearward end portions of said two elongate sides;

wherein said two elongate sides of said elongated slots and said two contact arms are configured for slidably interlocking said tail contact with said tip contact; and a bias member having a forward end engaging with said tip contact and a second end disposed within said pocket of said tail contact which is disposed adjacent said two contact arms.

2. The spring contact according to claim 1, wherein said tip contact further comprises a mounting protrusion which rearwardly extends from said central portion of said tip contact, with said mounting protrusion aligned for extending in a direction which extends into said pocket of said tail contact and said bias member extending around and receiving said mounting protrusion for engaging with said tip contact.

3. The spring contact according to claim 1, wherein said tail contact and said tip contact are slidably interlocked by means of protuberances extending from said tail contact into respective ones of said two elongate sides of said tip contact.

4. The spring contact according to claim 1, wherein said two contact arms have contact protuberances which outwardly extend from edges thereof and slidably engage within respective ones of said elongated slots within said two elongate sides.

5. The spring contact according to claim 4, further comprising said contact protuberances of said tail contact interlock with said elongated slots within said two elongate sides of said tip contact for slidably interlocking said tail contact to said tip contact.

6. The spring contact according to claim 1, wherein said single element member providing said tail contact further includes a plurality of spaced apart mounting barbs defining a second side of said U-shaped form.

7. The spring contact according to claim 6, wherein said pocket is defined between said mounting barbs and said contact arms.

8. The spring contact according to claim 7, wherein said mounting member is aligned for centrally disposing within said pocket when said tail contact is slidably secured to said tip contact.

9. The spring contact according to claim 8, wherein said two contact arms have contact protuberances which outwardly extend from edges thereof and slidably engage within respective ones of said elongated slots within said two elongate sides.

10. A spring contact comprising:

a tail contact formed of a first single element member having a main body portion which is of a U-shaped form, wherein a first side of said U-shaped form has a connecting protrusion and two resilient contact arms, said two resilient contact arms are spaced apart to define a space there-between which is disposed adjacent to a base portion of the connecting protrusion, said two resilient contact arms extend from said main body portion in a forward direction and said connecting protrusion is formed to extend from said main body portion in a rearward direction;

wherein said U-shaped form provides a pocket for trapping a rearward end portion of said bias member adjacent said contact arms;

a tip contact formed of a second single element member having a central portion from which a contact end forwardly extends, and two elongate sides and a mounting protrusion which rearwardly extend from said central portion, wherein said two elongate sides extend in parallel and in opposed relation from opposite sides of said central portion, and said mounting protrusion extends parallel to said two elongate sides, with said mounting protrusion disposed in orthogonal relation to said two sides, and said two sides having rearward end portions which rearwardly extend in cantilever arrangement from said central portion with two elongate slots formed into said rearward end portions of said two elongate sides;

wherein said two elongate sides and said elongated slots are configured for receiving respective ones of said contact protuberances, with said contact arms of said tail contact disposed between said rearward end portions of said two elongate sides of said tip contact, and with said mounting protrusion extending toward an intermediate portion of said U-shaped form of said main body portion of said tail contact, adjacent said contact arms; and said bias member having a forward end extending around and receiving said mounting protrusion, and a second end disposed within said pocket adjacent said two contact arms.

11. The spring contact according to claim 10, wherein said two contact arms have contact protuberances which outwardly extend from edges thereof and slidably engage within respective ones of said elongated slots within said two elongate sides.

12. The spring contact according to claim 11, further comprising said contact protuberances of said tail contact interlock with said elongated slots within said two elongate sides of said tip contact for slidably interlocking said tail contact to said tip contact.

13. The spring contact according to claim 10, wherein said single element member providing said tail contact further includes a plurality of spaced apart mounting barbs defining a second side of said U-shaped form.

14. The spring contact according to claim 13, wherein said pocket is defined between said mounting barbs and said contact arms.

15. The spring contact according to claim 10, wherein said mounting member is aligned for centrally disposing within said pocket when said tail contact is slidably secured to said tip contact.

16. The spring contact according to claim 15, wherein said two contact arms have contact protuberances which outwardly extend from edges thereof and slidably engage within respective ones of said elongated slots within said two elongate sides.

17. A spring contact comprising:

a tail contact formed of a first single element member having a main body portion which is of a U-shaped form, wherein a first side of said U-shaped form has a connecting protrusion and two resilient contact arms, said two resilient contact arms are spaced apart to define a space there-between which is disposed adjacent to a base portion of the connecting protrusion, said two resilient contact arms extend from said main body portion in a forward direction and said connecting protrusion is formed to extend from said main body portion in a rearward direction, said two contact arms have contact protuberances which outwardly extend from edges thereof;

wherein said single element member providing said tail contact further includes a second side of said U-shaped form having a plurality of spaced apart mounting barbs, and said U-shaped form provides a pocket for trapping a rearward end portion of said bias member between said mounting barbs and said contact arms;

a tip contact formed of a second single element member having a central portion from which a contact end forwardly extends, and two elongate sides and a bias member mounting protrusion which rearwardly extend from said central portion, wherein said two elongate sides extend in parallel and in opposed relation from opposite sides of said central portion, and said bias member mounting protrusion extends parallel to said two elongate sides, with said bias member mounting protrusion disposed in orthogonal relation to said two sides, and said two sides having rearward end portions which rearwardly extend in cantilever arrangement from said central portion with two elongate slots formed into said rearward end portions of said two elongate sides;

wherein said two elongate sides and said elongated slots are configured for receiving respective ones of said contact protuberances, with said contact arms of said tail contact disposed between said rearward end portions of said two elongate sides of said tip contact, and with said bias member mounting protrusion extending toward an intermediate portion of said U-shaped form of said main body portion of said tail contact, intermediate between said contact arms and said mounting barbs; and said bias member having a forward end extending around and receiving said bias member mounting protrusion, and a second end disposed within said pocket between said two contact arms and said mounting barbs.

* * * * *